US011746966B2

(12) United States Patent
Singh

(10) Patent No.: US 11,746,966 B2
(45) Date of Patent: Sep. 5, 2023

(54) LED MESH LIGHT FLAG

(71) Applicant: Fresh Source International Inc., Elmhurst, IL (US)

(72) Inventor: Ajay Singh, Hoffman Estates, IL (US)

(73) Assignee: Fresh Source International Inc., Elmhurst, IL (US)

( * ) Notice: Subject to any disclaimer, the term of this patent is extended or adjusted under 35 U.S.C. 154(b) by 0 days.

(21) Appl. No.: 17/850,451

(22) Filed: Jun. 27, 2022

(65) Prior Publication Data

US 2022/0412518 A1 Dec. 29, 2022

Related U.S. Application Data

(60) Provisional application No. 63/215,625, filed on Jun. 28, 2021.

(51) Int. Cl.

| | |
|---|---|
| ***F21S 4/15*** | (2016.01) |
| ***F21S 9/03*** | (2006.01) |
| ***F21V 21/06*** | (2006.01) |
| ***F21V 21/02*** | (2006.01) |
| *F21Y 113/10* | (2016.01) |
| *F21Y 115/10* | (2016.01) |

(52) U.S. Cl.

CPC . *F21S 4/15* (2016.01); *F21S 9/03* (2013.01); *F21V 21/02* (2013.01); *F21V 21/06* (2013.01); *F21Y 2113/10* (2016.08); *F21Y 2115/10* (2016.08)

(58) Field of Classification Search

CPC .. F21Y 2115/10; F21Y 2113/10; F21V 21/02; F21V 21/06; F21S 9/03; F21S 4/15

See application file for complete search history.

(56) References Cited

U.S. PATENT DOCUMENTS

| | | | | |
|---|---|---|---|---|
| 5,667,295 | A * | 9/1997 | Tsui | F21S 4/10 362/267 |
| 10,907,786 | B2 * | 2/2021 | Chen | H05B 47/19 |
| 11,226,089 | B1 * | 1/2022 | McRae | E06B 9/42 |
| 11,293,605 | B1 * | 4/2022 | Massinello | F21V 23/001 |
| 2020/0208794 | A1 * | 7/2020 | Stange | F21V 21/0816 |
| 2022/0003365 | A1 * | 1/2022 | McRae | H05B 45/46 |

FOREIGN PATENT DOCUMENTS

KR 101784708 B1 * 9/2017

* cited by examiner

*Primary Examiner* — Anabel Ton

(74) *Attorney, Agent, or Firm* — The Webb Law Firm

(57) ABSTRACT

Provided herein are embodiments of a banner assembly, for example, a banner assembly having a light-emitting diode (LED) light network arranged in a pattern of a national flag thereby illuminating the national flag for display. The banner assembly herein comprises an LED light network having LED lights arranged in a pattern of a national flag, and a plurality of detachable rods attached to the LED light network by one or more connector.

12 Claims, 4 Drawing Sheets

LED MESH LIGHT FLAG

CROSS-REFERENCE TO RELATED APPLICATION

The present application claims priority to U.S. Provisional Application Ser. No. 63/215,625, entitled "LED Mesh Light Flag", filed Jun. 28, 2021, the entire disclosure of which is hereby incorporated by reference in its' entirety.

SUMMARY OF THE INVENTION

Field of the Invention

The present invention is directed towards a banner assembly, for example, a banner assembly having a light-emitting diode (LED) light network arranged in a pattern of a national flag thereby illuminating the national flag for display.

Proper flag displaying etiquette requires a flag to be properly displayed during both daytime and nighttime hours. There are several different types of flags that have become increasingly popular to display, such as national flags, advertising and organizational flags, as well as pennants flying on flagpoles. Typically, these flags are poorly lit or not visible during nighttime hours, violating proper flag etiquette. Proper flag etiquette requires that flags and pennants be visible at any time of the day or night and at any time of the year.

In one aspect or embodiment of the subject matter disclosed herein, a banner assembly is provided. The banner assembly comprises a light-emitting diode (LED) light network attached to a frame, the LED light network having LED lights arranged in a pattern of a national flag. The banner assembly further comprises a plurality of detachable rods attached to each other by a connector and a power source configured to provide power to the LED lights, the power source comprising a solar panel or an AC adaptor. In some embodiments, the plurality of detachable rods are attached to the LED light network by the connector. In some embodiments, the connector has at least one connection port configured to receive the plurality of detachable rods, and, optionally, one or more hooks configured to receive the wall hook.

Various aspects of the present disclosure may be further characterized by one or more of the following clauses:

Clause 1: A banner assembly, comprising a light-emitting diode (LED) light network attached to a frame, the LED light network having LED lights arranged in a pattern of a national flag; a plurality of detachable rods attached to each other by a connector; and a power source configured to provide power to the LED lights, the power source comprising a solar panel or an AC adaptor, wherein the plurality of detachable rods are attached to the LED light network by the connector, and wherein the connector has at least one connection port configured to receive the plurality of detachable rods, and, optionally, one or more hooks configured to receive a wall hook.

Clause 2: A banner assembly, comprising a light-emitting diode (LED) light network attached to a frame, the LED light network having LED lights arranged in a pattern of a national flag; a plurality of detachable rods attached to each other by a connector; and a power source configured to provide power to the LED lights, the power source comprising a solar panel or an AC adaptor, wherein the plurality of detachable rods are attached to the LED light network by the connector, and wherein the connector has at least one connection port configured to receive the plurality of detachable rods, and one or more hooks configured to receive the wall hook.

Clause 3: The banner assembly of clause 1 or 2, further comprising the wall hook attached to a perimeter of the LED light network by the connector.

Clause 4: The banner assembly of any of clauses 1 to 3, further comprising a mount pole attached to the LED light network by the connector.

Clause 5: The banner assembly of any of clauses 1 to 4, wherein the AC adaptor is an AC 120V with 30V power adaptor.

Clause 6: The banner assembly of any of clauses 1 to 5, wherein the connector is a female connector, optionally a non-threaded female connector, having two, three, four, or five connection ports.

Clause 7: The banner assembly of any of clauses 1 to 6, wherein the connector is a female connector having two, three, four, or five connection ports.

Clause 8: The banner assembly of any of clauses 1 to 7, wherein the connector is a non-threaded female connector having two, three, four, or five connection ports.

Clause 9: The banner assembly of any of clauses 1 to 8, wherein the plurality of detachable rods are arranged in an x-configuration or a square configuration.

Clause 10: The banner assembly of any of clauses 1 to 9, wherein the plurality of detachable rods are arranged in an x-configuration.

Clause 11: The banner assembly of any of clauses 1 to 10, wherein the plurality of detachable rods are arranged in a square configuration.

Clause 12: The banner assembly of any of clauses 1 to 11, wherein the LED lights comprise one or more colors.

Clause 13: The banner assembly of any of clauses 1 to 12, wherein the frame is a plastic frame or a clear plastic frame.

Clause 14: The banner assembly of any of clauses 1 to 13, wherein the frame is a plastic frame.

Clause 15: The banner assembly of any of clauses 1 to 14, wherein the frame is a clear plastic frame.

Clause 16: The banner assembly of any of clauses 1 to 15, wherein the pattern is selected from the group consisting of waves, sequential, slo-glo, chasing, flashing, slow fade, twinkle, flash, and steady-on.

Clause 17: The banner assembly of any of clauses 1 to 16, wherein the pattern is waves.

Clause 18: The banner assembly of any of clauses 1 to 17, wherein the pattern is sequential.

Clause 19: The banner assembly of any of clauses 1 to 18, wherein the pattern is slo-glo.

Clause 20: The banner assembly of any of clauses 1 to 19, wherein the pattern is chasing.

Clause 21: The banner assembly of any of clauses 1 to 20, wherein the pattern is flashing.

Clause 22: The banner assembly of any of clauses 1 to 21, wherein the pattern is slow fade.

Clause 23: The banner assembly of any of clauses 1 to 22, wherein the pattern is twinkle.

Clause 24: The banner assembly of any of clauses 1 to 23, wherein the pattern is flash.

Clause 25: The banner assembly of any of clauses 1 to 24, wherein the pattern is steady-on.

Clause 26: The banner assembly of any of clauses 1 to 25, wherein the banner assembly is waterproof.

Clause 27: The banner assembly of any of clauses 1 to 26, wherein the national flag is a United States of America flag.

DESCRIPTION OF THE INVENTION

Embodiments will now be described with reference to FIGS. 1A-1C, 2A-D, and 3, which relate to a banner assembly having an LED light network arranged in a pattern of a national flag and plurality of detachable rods. Moreover, it is contemplated that while the present invention is disclosed hereinafter with respect to a banner assembly for illuminating a flag, the present invention may be used for various items to be illuminated including, but not limited to, a banner or pennant.

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of elements used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Figure 2A:
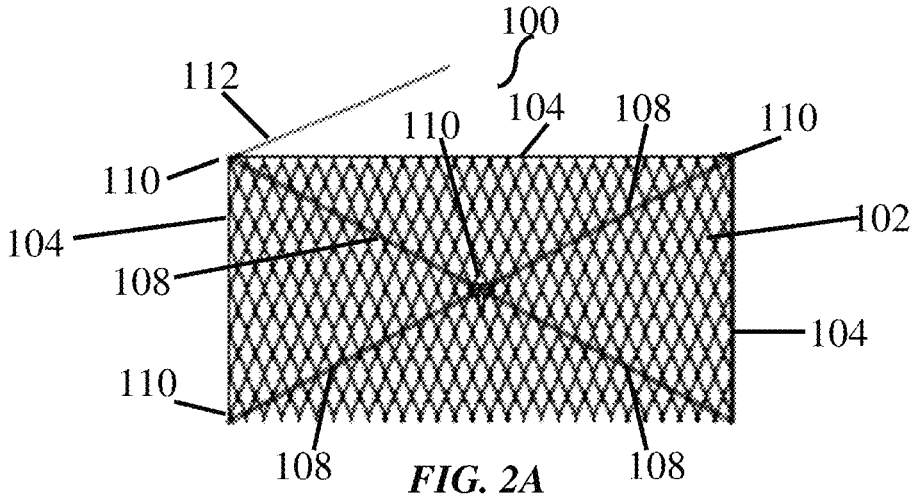
FIG. 2A is a front view of a banner assembly having detachable rods in an x-configuration and a wall hook in accordance with certain embodiments.
Figure 2B:
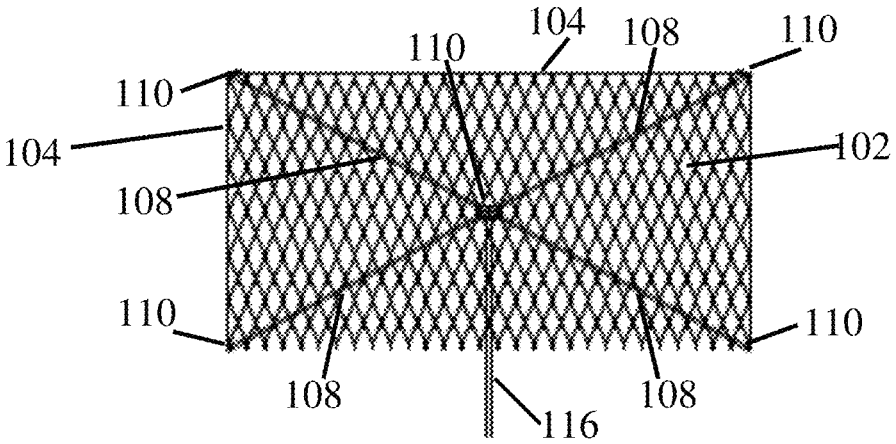
FIG. 2B is a front view of a banner assembly having detachable rods in an x-configuration and a mount pole in accordance with certain embodiments.
Figure 2C:
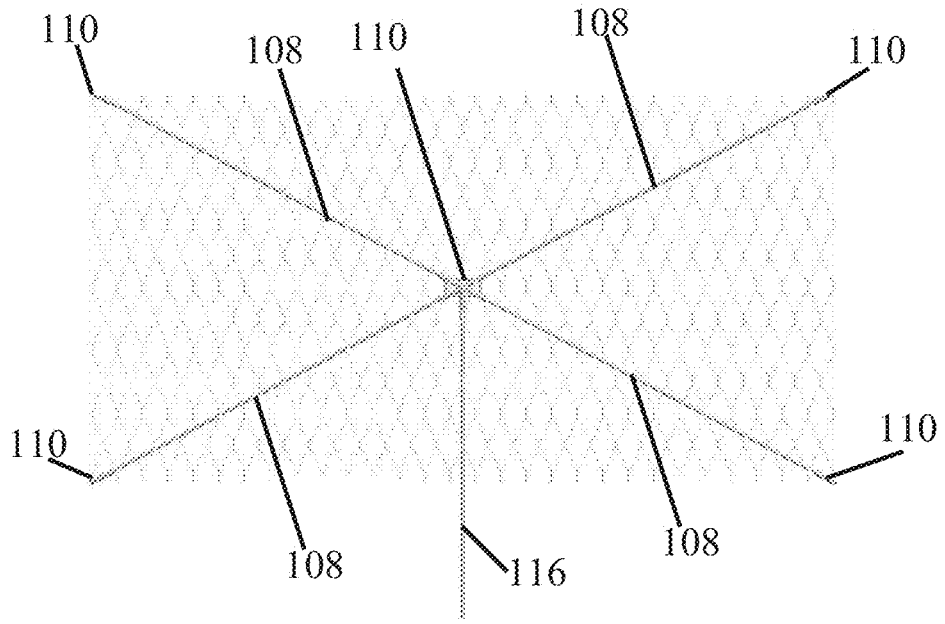
FIG. 2C is a front view of a banner assembly having detachable rods in an x-configuration and a mount pole in accordance with another embodiment.
Figure 2D:
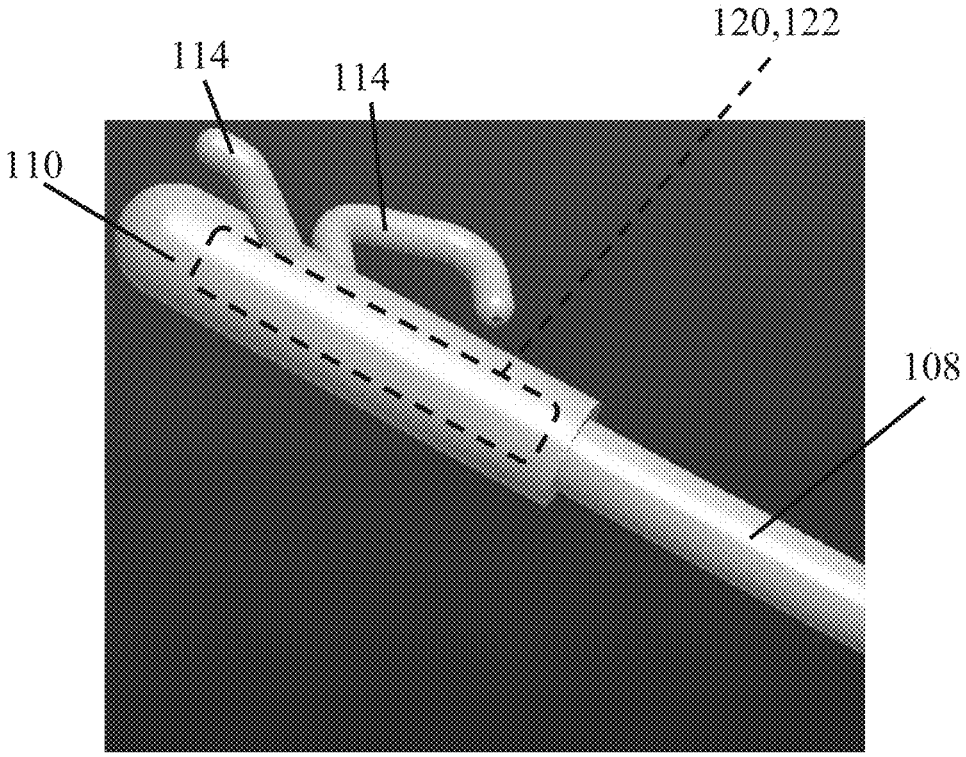
FIG. 2D is a perspective view of an embodiment of a connector having two hooks in accordance with certain embodiments.
Figure 3:
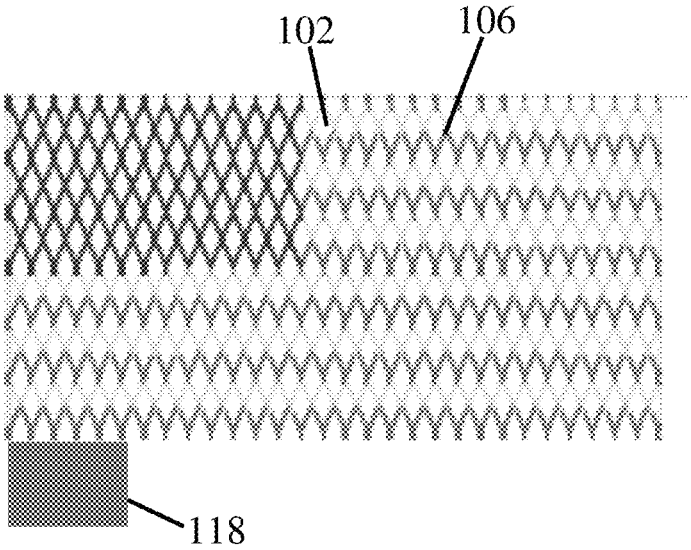
FIG. 3 is a front view of a banner assembly having a LED light network with LED lights arranged in a pattern of a national flag and a power source.

FIGS. 1A-3 are embodiments of a banner assembly 100. Banner assembly 100 comprises a light-emitting diode (LED) light network 102 attached to a frame 104, the LED light network 102 having LED lights 106. In some embodiments, LED lights 106 are arranged in a pattern of a national flag. In some embodiments, LED lights are arranged in a pattern of a banner or pennant. In some embodiments, LED lights 106 comprise one or more colors. In some embodiments, as depicted in FIG. 3, LED lights 106 have one or more colors and are arranged in the pattern of the United States of America (FIG. 3).

In further reference to FIGS. 1A-3, a plurality of detachable rods 108 is provided. The plurality of detachable rods 108 can be attached to each other by a connector 110. In some embodiments, the connector 110 can be a female connector 120. In some embodiments, the connector 110 can be a non-threaded female connector 120. In some embodiments, the connector 110 has one or more connection ports 122. As will be understood by those of skill in the art, a connection port 122 provides a physical interface between devices, for example, a plurality of detachable rods. In some embodiments, the connector 110 has at least one connection port 122 configured to receive the plurality of detachable rods. In some embodiments, the connector 110 has one, two, three, four, or five connection ports 122. In some embodiments, the connector 110 has one connection port 122. In some embodiments, the connector 110 has two connection ports 122. In some embodiments, the connector 110 has three connection ports 122. In some embodiments, the connector 110 has four connection ports 122. In some embodiments, the connector 110 has five connection ports 122.

The banner assembly of FIGS. 1A-3 may further comprise a power source 118 (FIG. 3). In some embodiments, the power source 118 is configured to provide power to LED lights 106. In some embodiments, the power source 118 may comprise a solar panel or an AC adaptor. In some embodiments, the AC adaptor is an AC 120V with 30V power adaptor.

In some embodiments, the banner assembly 100 comprises an LED light network 102 attached to a frame 104, the LED light network 102 having LED lights 106. In some embodiments, the plurality of detachable rods are attached to the LED light network 102 by the connector 110.

Figure 1A:
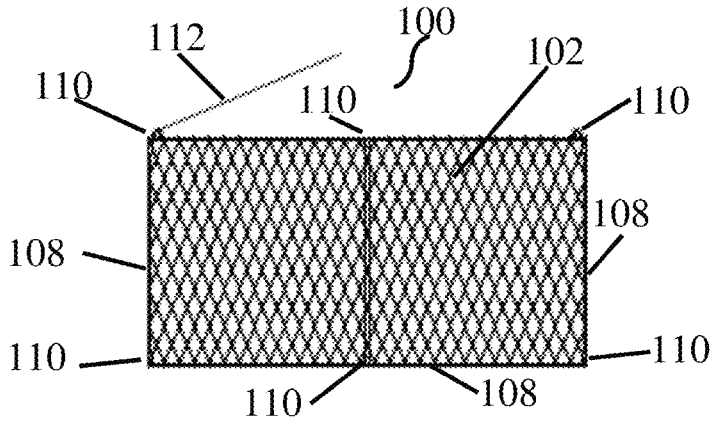
FIG. 1A is a front view of a banner assembly having detachable rods in a square configuration and a wall hook in accordance with certain embodiments.

In some embodiments, the connector 110 further comprises one or more hooks 114 (FIG. 1C) which are configured to receive a wall hook 112 (FIGS. 1A and 2A). In some embodiments, a wall hook 112 is attached to a perimeter of an LED light network 102 by a connector 110.

Figure 1B:
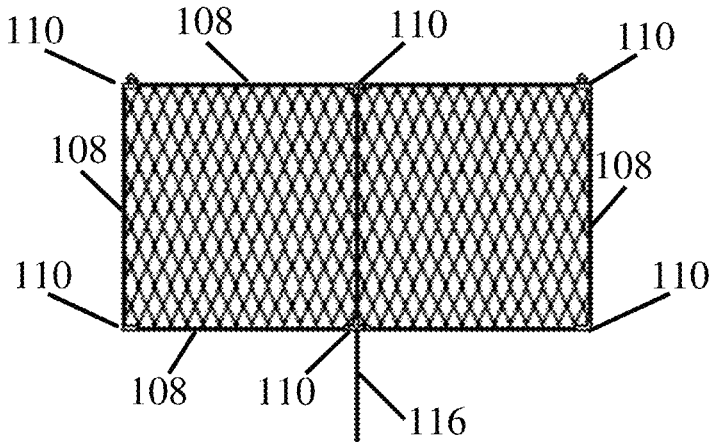
FIG. 1B is a front view of a banner assembly having detachable rods in a square configuration and a mount pole in accordance with certain embodiments.
Figure 1C:
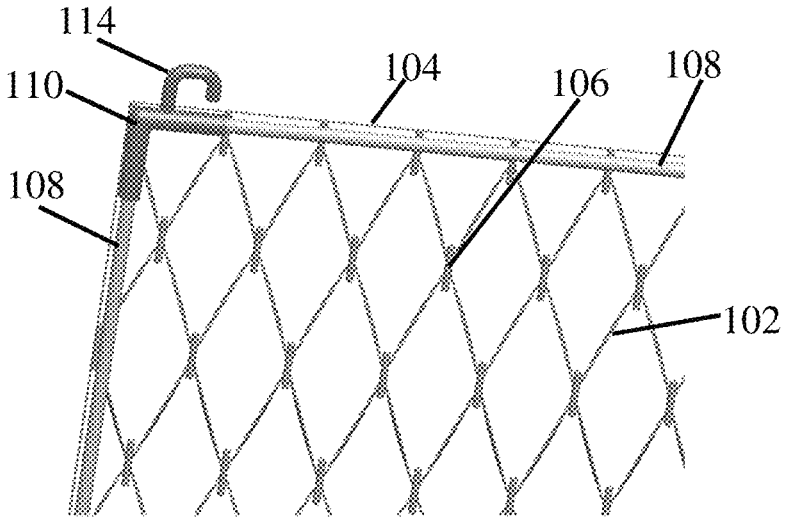
FIG. 1C is a perspective view of an embodiment of a banner assembly having a connector with a hook.

In some embodiments, a banner assembly 100 may further comprise a mount pole 116 attached to an LED light network 102 by a connector 110 (FIGS. 1B and 2B).

In some embodiments, the plurality of detachable rods 108 are arranged in a square configuration (FIGS. 1A-1B). In some embodiments, the plurality of detachable rods 108 are arranged in a square configuration wherein a mount pole 116 is attached to a perimeter of an LED light network 102 by a connector 110 (FIG. 1B). In some embodiments, the plurality of detachable rods 108 are arranged in an X-configuration (FIGS. 2A-2B). In some embodiments, the plurality of detachable rods 108 are arranged in an X-configuration wherein a mount pole 116 is attached to a center of an LED light network 102 by a connector 110 (FIG. 2B).

In some embodiments, a frame 104 is a plastic frame or a clear plastic frame.

In some embodiments, LED lights 106 are powered such that LED lights 106 are illuminated in a pattern. The illumination pattern may include waves, sequential, slo-glo, chasing, flashing, slow fade, twinkle, flash, and steady-on.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. Further, in this application, the use of "a" or "an" means "at least one" unless specifically stated otherwise.

About" as used herein means ±10% of the referenced value. In certain embodiments, "about" means ±9%, or ±8%, or ±7%, or ±6%, or ±5%, or ±4%, or ±3%, or ±2% or ±1% of the referenced value.

The invention claimed is:

1. A banner assembly, comprising:

a light-emitting diode (LED) light network attached to a frame, the LED light network having LED lights arranged in a pattern of a national flag;

a plurality of detachable rods attached to each other by a connector; and a power source configured to provide power to the LED lights, the power source comprising a solar panel or an AC adaptor, wherein the plurality of detachable rods are attached to the LED light network by the connector, and wherein the connector has at least one connection port configured to receive the plurality of detachable rods.

2. The banner assembly of claim 1, further comprising one or more hooks configured to receive a wall hook.

3. The banner assembly of claim 1, further comprising a wall hook attached to a perimeter of the LED light network by the connector.

4. The banner assembly of claim 1, further comprising a mount pole attached to the LED light network by the connector.

5. The banner assembly of claim 1, wherein the AC adaptor is an AC 120V with 30V power adaptor.

6. The banner assembly of claim 1, wherein the connector is a female connector, optionally a non-threaded female connector, having two, three, four, or five connection ports.

7. The banner assembly of claim 1, wherein the plurality of detachable rods are arranged in an x-configuration or a square configuration.

8. The banner assembly of claim 1, wherein the LED lights comprise one or more colors.

9. The banner assembly of claim 1, wherein the frame is a plastic frame or a clear plastic frame.

10. The banner assembly of claim 1, wherein the pattern is selected from the group consisting of waves, sequential, slo-glo, chasing, flashing, slow fade, twinkle, flash, and steady-on.

11. The banner assembly of claim 1, wherein the banner assembly is waterproof.

12. The banner assembly of claim 1, wherein the national flag is a United States of America flag.

* * * * *